US006121883A

United States Patent [19]

Hatsir

[11] Patent Number: 6,121,883

[45] Date of Patent: Sep. 19, 2000

[54] METHOD AND DEVICE FOR FLUID PRESSURE ANALYTICAL ELECTRONIC HEAT AND FIRE DETECTION

[76] Inventor: Eli Hatsir, Ha Shounit Street, Bldg. 2, Apt. 24, Ashkelon, Israel

[21] Appl. No.: 09/469,215

[22] Filed: Dec. 22, 1999

[51] Int. Cl.[7] ..... G08B 17/00

[52] U.S. Cl. ..... 340/584; 340/587; 340/594; 340/449; 340/592; 340/626

[58] Field of Search ..... 340/584, 587, 340/594, 449, 592, 626

[56] References Cited

U.S. PATENT DOCUMENTS

| | | | |
|---|---|---|---|
| 4,651,140 | 3/1987 | Duggan | 340/592 |
| 5,136,278 | 8/1992 | Watson et al. | 340/584 |
| 5,621,389 | 4/1997 | Fellows | 340/584 |
| 5,691,702 | 11/1997 | Hay | 340/626 |

FOREIGN PATENT DOCUMENTS

| | | | |
|---|---|---|---|
| 350440 | 10/1990 | European Pat. Off. | G08B 17/04 |

OTHER PUBLICATIONS

UL 521, Heat Detectors for Fire Protective Signaling Systems, Underwriters Laboratories, Inc., 333 Pfingsten Road, Northbrook, IL,60062–2096, USA, 7th Ed., 1999.

*Primary Examiner*—Jeffery A. Hofsass
*Assistant Examiner*—Tai T. Nguyen
*Attorney, Agent, or Firm*—Mark M. Friedman

[57] ABSTRACT

A method for fluid pressure analytical electronic heat and fire detection, and a corresponding heat detector, used for detecting heat and fire, having no moving component, such as a valve, switch, membrane, diaphragm, or similar actuatable device of moving parts, for effecting activation of a warning or alarm signal indicating a condition of excessive heat or fire. The analytical electronic heat detection mechanism is based on electronic circuitry including at least one fluid pressure transducer, logic, and other cooperatively functioning electronic components, for highly accurately and reproducibly, first analyzing a potential condition, and then logically determining, an actual condition of excessive heat or fire. The electronic heat detection mechanism is fully functional, by having at least one fluid chamber closed to any external source of fluid pressure. The invention includes an automatic electronic testing procedure for naturally stimulating the heat detection mechanism for effecting operation. The invention can be implemented in a variety of configurations, including, as a spot type or line-type heat detector, closed or open fluid pressure type heat detector, operating in different ways for monitoring temperature, such as fixed temperature and/or rate of temperature rise, and, in a variety of applications, including incorporating them into multi-unit systems of automatic excessive heat and fire detection, encompassing a wide range of environmental conditions, in a cost effective manner.

59 Claims, 1 Drawing Sheet

METHOD AND DEVICE FOR FLUID PRESSURE ANALYTICAL ELECTRONIC HEAT AND FIRE DETECTION

FIELD AND BACKGROUND OF THE INVENTION

The present invention relates to automatic heat detection and, more particularly, to a method for fluid pressure analytical electronic heat and fire detection, and a corresponding heat detector, used for detecting excessive heat and fire.

Automatic heat detection methods, devices, and systems are implemented for detecting spontaneous occurrence of overheating or excessive heat generation in general, and in particular, when the heat is associated with or caused by a fire. Currently used methods and equipment for automatically detecting a fire are based on detecting different phenomena related to the fire, such as the presence of smoke, radiation, or excessive heat. A first example involves detecting the presence of smoke, by a smoke detector, as the result of something burning, which is normally quite effective for indirectly indicating the presence of a fire. A second example involves detecting radiation emitted by the flames of a fire, by radiation absorption or electro-optical techniques, which are also effective for indirectly indicating the presence of a fire. A third example, involves detecting the occurrence of excessive heat, by a heat detector, directly associated with and at the location of the fire itself, or, caused by the fire but at a distance from the actual fire.

A given fire detector operating with a fire detection mechanism for detecting a fire according to one of the above described types of fire related phenomena is limited to the design and operation of that particular fire detection mechanism. For example, a smoke detector features a smoke detection mechanism for detecting the presence of smoke, which is not designed for, nor capable of, detecting other fire-related phenomena of radiation or excessive heat. A radiation detector features a radiation detection mechanism for detecting emitted radiation, which is not designed for, nor capable of, detecting smoke or excessive heat. Similarly, a heat detector features a heat detection mechanism for detecting excessive heat, which is not designed for, nor capable of, detecting smoke or radiation. Each type of fire detector has particular advantages and disadvantages, usually defined by the characteristics, requirements, and environmental conditions of a particular fire detection application.

Compared to using a heat detector for detecting a condition of excessive heat or fire, there are several specific disadvantages of using fire detectors based upon detecting the other fire related phenomena of smoke and radiation. In particular, proper operation of a smoke or radiation type fire detector strongly depends upon the detection mechanism being located in an area or environment having minimal amounts of interferences such as non-fire related smoke or radiation, fumes of smoke, vapor, or gas, oil, dust, and dirt.

For example, activated mechanical equipment such as running engines, motors, and industrial machinery, are typically accompanied by generation of such interferences. The presence of such interferences can cause malfunction or even non-function of a smoke or radiation type fire detector, leading to a potentially hazardous situation. Moreover, as a result of the affects of interferences, smoke and radiation type fire detectors are typically limited to indoor or other environmentally favorable applications. In general, the above described types of non-fire related interferences minimally influence the performance of heat detectors operating with a mechanism for detecting heat. Accordingly, heat detectors based on detecting excessive heat or fire usually perform more accurately and reliably in applications involving unfavorable environmental conditions, such as in the immediate vicinity of running engines or in outdoor applications.

Another significant disadvantage of using a smoke or radiation type fire detector relates to the response time required for detecting a condition of excessive heat or fire. Based on the fact that smoke and radiation type fire detectors are ordinarily not capable of properly functioning at ground zero 'hot' points of excessive heat or fire generation, whereas there are specific types of heat detectors capable of being located and fully functional at such 'hot' points, response time to a condition of excessive heat or fire is usually shorter for those types of heat detectors.

The UL 521, Heat Detectors For Fire Protective Signaling Systems, Underwriter Laboratories Inc., IL, USA, seventh edition, 1999, classifies heat detection methods and heat detectors according to a list of various characteristics relating to the type of heat detection mechanism, and according to the physical site, location, or configuration of detection by the heat detection mechanism. Each type of heat detector typically has advantages and disadvantages. Ultimately, the type of heat detector used in a particular application is selected according to specific characteristics, environmental conditions, and requirements of the application.

With respect to the type of heat detection mechanism, a heat detection mechanism is of either an electronic type or non-electronic type. An electronic type heat detection mechanism indicates that electronic circuitry, featuring operation of a single electronic component such as a resistor, or featuring design and cooperative operation of several active and/or passive electronic components on a printed circuit board, is used for responding to a condition of excessive heat or fire, for example, by electronically monitoring temperature and/or rate of temperature rise.

A non-electronic type heat detection mechanism typically features a simple electrical contact, connection, or switch, which is closed by melting of heat sensitive wire insulation, for example, in the case of a thermal or heat-sensitive cable heat detector, or, by actuation of a mechanical mechanism such as a valve, switch, membrane, or diaphragm, for example, in the case of a pneumatic, or gas pressure, type heat detector, where the mechanical mechanism is actuated by an increase in gas pressure due to a rise in temperature as a result of a condition of excessive heat or fire. Typically, a non-electronic type heat detection mechanism is connected to separate electronic circuitry for activating a warning or alarm signal indicating a condition of excessive heat or fire, where the electronic circuitry is not itself involved in detecting or responding to the condition of excessive heat or fire.

Electronic type heat detection mechanisms are generally more adjustable, sensitive, and robust, than non-electronic mechanisms. Electronic type heat detection mechanisms are readily adjustable for high sensitivity, and therefore quick responsiveness, to a condition of excessive heat or fire. Moreover, electronic type heat detection mechanisms are highly robust in that they can be applied at locations having widely varying environmental conditions, whereby the detection mechanism accurately and reproducibly functions with minimal interference by normal variation of environmental conditions. For example, variations in temperatures and pressures, not corresponding to excessive heat or fire in the immediate vicinity of a non-electronic heat detection mechanism, can interfere with and limit proper functioning of a non-electronic type heat detector, causing the heat detector to provide a false warning or alarm signal.

Electronic and non-electronic types of heat detection mechanisms can be operated according to a fixed temperature and/or according to a rate of temperature rise. According to the fixed temperature type of operation, the heat detector features a heat detection mechanism, which, upon detecting a temperature at or above a pre-determined threshold level, is responsive for providing a warning or alarm signal. According to the rate of temperature rise type of operation, the heat detector features a heat detection mechanism, which, upon detecting a rate of temperature rise at or above a pre-determined threshold level, is responsive for providing a warning or alarm signal. A heat detector can be designed and operated according to both a fixed temperature and according to a rate of temperature rise, by featuring a heat detection mechanism adjusted to be responsive to a temperature at or above a pre-determined threshold level and/or to a rate of temperature rise at or above a pre-determined threshold level.

Rate of temperature rise heat detectors are generally more robust than fixed temperature heat detectors, with respect to performance accuracy and reproducibility. Firstly, rate of temperature rise heat detectors are usually electronic, thereby featuring the advantages of operating with an electronic heat detection mechanism. Secondly, detecting a rate of temperature rise above a pre-determined threshold level is considered more accurate than detecting a fixed temperature above a pre-determined threshold level, with respect to identifying a condition of excessive heat or fire.

Heat detectors whose heat detection mechanism operates according to one of either detecting excessive heat, or, detecting flames or fire, are characterized as being single mode. Heat detectors whose heat detection mechanism operates according to detecting excessive heat and/or detecting fire, are characterized as being dual mode. A given single mode or dual mode heat detector can be operated according to a fixed temperature and/or according to a rate of temperature rise. In general, dual mode type heat detectors are more accurate and reliable than single mode type detectors, due to the simultaneous capability of detecting two fire related characteristics of excessive heat and/or fire.

A restorable heat detector features a heat detection mechanism, which, upon detecting and responding to a condition of excessive heat or fire, is not irreversibly damaged or destroyed, in contrast to the heat detection mechanism of a non-restorable heat detector. Restoration or re-setting of the heat detection mechanism of a restorable heat detector may be manual or automatic, where an automatically restorable heat detector is known as a self-restoring heat detector. An example of a non-restorable heat detector is a heat sensitive cable type heat detector which operates by excessive heat or fire melting a heat sensitive coating over wires. This type of heat detector is limited in that upon melting of the coating, the heat detection mechanism is destroyed.

With respect to the physical site or location of detection by the heat detection mechanism, a heat detector is of either a spot type or a line, or linear, type. A spot type heat detector features a heat detection mechanism physically concentrated or located at a particular location or spot, and detects a condition of excessive heat or fire only at that particular location or spot. This is in contrast to a line, or linear, type heat detector which features a heat detection mechanism continuously located along a path, and detects a condition of excessive heat or fire continuously along the entire path. The heat detection mechanism of a line or linear type heat detector can be considered as a continuous series of spot type heat detection mechanisms, with respect to detecting a condition of excessive heat or fire.

A line-type heat detector is typically more versatile and responsive than a spot type detector. One advantage of a line-type heat detector over a spot type heat detector is that of featuring a higher density of excessive heat or fire detection. The physical range of heat or fire detection by a line-type heat detector can be made to be significantly larger than the detection range of a spot type heat detector. In particular, a line-type heat detector is not limited by the heat detection mechanism being located at a single spot in a give location, such as on the ceiling or wall of a room.

A second advantage of a line-type heat detector relates to response time by which a heat detector responds to a condition of excessive heat or fire. A spot type heat detector normally requires significantly longer times for reaching an activated state of responding to excessive heat or fire, due to the time required for heat transfer from ground zero 'hot' points of the excessive heat or fire to the location of the spot type heat detection mechanism, whereas, a line-type heat detector operating with a higher density of excessive heat or fire detection, usually has its heat detection mechanism located closer to, or even at, ground zero 'hot' points of the excessive heat or fire.

For example, in the event of a condition of excessive heat or fire occurring at or near an activated engine or piece of machinery, in the case of a line-type heat detector, the excessive heat or fire is quickly detected because the line-type heat detection mechanism is typically in physical contact with the engine or machinery, in contrast to a spot type heat detection mechanism which is typically located a distance away from the engine or machinery, requiring significantly more time for responding to the condition of excessive heat or fire. Moreover, a spot type heat detection mechanism usually requires a condition of fire, and not just of excessive heat, for activation, which, by the time the spot type heat detector is activated, there may develop a more serious or hazardous situation. For example, in scenarios like the one just described, a line-type heat detector can actually lead to saving a burning engine or piece of machinery, whereas using a spot type heat detector in the vicinity of the engine or piece of machinery will probably result in complete burning, or irreversible damage, of the engine or machinery, prior to potentially saving it.

A third advantage is that a line-type heat detector is usually more applicable to environmental conditions unfavorable to properly detecting a condition of excessive heat or fire. A line-type heat detection mechanism can readily be located in an area or environment, for example, near activated mechanical equipment such as running engines, motors, and industrial machinery, typically associated with significant amounts of smoke, radiation, fumes of smoke, vapor, or gas, oil, dust, and dirt, which, near the detection region of a spot type heat detector may interfere with proper operation of the heat detection mechanism, causing malfunction or even total inactivation of the spot type heat detector, ultimately leading to a potentially hazardous situation.

There are currently available different types of heat detectors, each featuring either a non-electronic or an electronic type of heat detection mechanism, where the heat detection mechanism is based on, for example, heat or thermal sensitivity, or, pneumatics. Furthermore, as described above, each of these heat detection mechanisms can operate according to a fixed temperature and/or according to a rate of temperature rise.

A first example is a heat or thermally sensitive cable non-electronic line-type heat detector, operating according to a fixed temperature, which, aside from featuring previously described advantages of line-type heat detectors, is limited by being non-electronic, and by the cable typically being sensitive to environmental effects such as mechanical contact, shock, bending, and squeezing. Moreover, this kind of line-type heat detector is non-restorable due to destruction of the cable upon detection of a condition of excessive heat or fire.

A second example is a heat or thermally sensitive resistance electronic line-type heat detector, operating according to a fixed temperature, whereby resistance of a resistor decreases with increasing temperature, up to a fixed temperature, causing the shorting, or closing, of a circuit in the heat detection mechanism for responding to a condition of excessive heat or fire. This line-type heat detector has several disadvantages, such as the need for the resistor in the heat detection mechanism to generate a significant quantity of heat in order to respond to temporal changes in temperature associated with that of excessive heat or a fire, response time is relatively slow for an electronic line-type heat detector, and is limited to indoor use.

A third example is the category of pneumatic non-electronic heat detectors, including spot type and line-type pneumatic heat detectors, where the heat detection mechanism operates according to a fixed temperature and/or a rate of temperature rise. A pneumatic non-electronic heat detector features a pneumatic non-electronic heat detection mechanism which operates according to changes in gas pressure due to changes in temperature, and for a gas pressure, or rate of gas pressure rise, above a pre-determined threshold level, corresponding to a temperature, or rate of temperature rise above a pre-determined threshold level, respectively, there is actuation of a mechanical mechanism, involving movement of a valve, switch, membrane, or diaphragm, effecting closure of an electrical contact, connection, switch, or electronic circuit, followed by activation of a warning or alarm signal for indicating a condition of excessive heat or fire.

In a pneumatic non-electronic heat detector, the pneumatic non-electronic heat detection mechanism may be either closed or open, with respect to an external source of gas, for example, ambient atmosphere. In a closed pneumatic non-electronic heat detector, an enclosed internal volume of gas is closed to any external source of gas, such as ambient atmosphere. In an open pneumatic non-electronic heat detector, there is included at a particular location along the enclosed volume of gas a small passageway open to an external source of gas, usually configured and functioning as a gas flow restrictor, for example, an open capillary tube or orifice, for enabling equilibration of internal gas pressure with the external source of gas pressure, thereby, enabling compensation of variations in internal gas pressure due to normal variations in the temperature of the environment being monitored for a condition of excessive heat or fire.

A significant general limitation of currently available pneumatic non-electronic heat detectors, including closed or open types, spot types or line-types, operating according to a fixed temperature and/or rate of temperature rise, is that they are non-electronic, whereby operation of the particular heat detection mechanism is based on actuation of a mechanical mechanism, involving movement of a valve, switch, membrane, diaphragm, or similar actuatable device featuring one or more moving parts, for effecting closure of an electrical contact, connection, switch, or electronic circuit. Moreover, a pneumatic non-electronic heat detection mechanism typically requires a significant level of gas pressure in order cause actuation of the one or more moving parts.

Furthermore, the pneumatic non-electronic heat detection mechanism responds to, but cannot analyze, a potential or possible, condition of excessive heat or fire. A pneumatic non-electronic heat detection mechanism is not capable of analyzing the pneumatics, or the mechanics, of the actuation of the mechanical mechanism. Once actuation of the mechanical mechanism is complete, proper operation of a pneumatic non-electronic heat detection mechanism irreversibly leads to effecting a warning or alarm signal indicating a condition of excessive heat or fire, regardless of the condition of excessive heat or fire being actual or not, or, in logic terms, true or false. As such, a pneumatic non-electronic heat detection mechanism may respond to false conditions of excessive heat or fire, caused by a variety of reasons.

Accordingly, accuracy and reproducibility of pneumatic non-electronic heat detectors are directly related to, and totally dependent upon, the accuracy and reproducibility of the process of actuating the mechanical mechanism, and therefore, of operation of the one or more moving parts. Clearly, sufficient interference or failure in proper actuation or operation of the mechanical mechanism precludes proper functioning of the heat detection mechanism, consequently resulting in such a heat detector either responding to false conditions of excessive heat or fire, performing below specifications, or not performing at all, leading to a potentially hazardous situation.

Further, with respect to an open pneumatic non-electronic heat detector, its performance level is determined by the extent to which variations in the internal gas pressure are accurately and reproducibly compensated for by equilibration with atmospheric pressure. This feature limits applicability of an open pneumatic non-electronic heat detector in two specific ways, as explained here.

First, a properly designed, calibrated, and adjusted open pneumatic non-electronic heat detection mechanism with respect to a particular atmospheric pressure is still vulnerable to variations in the atmospheric pressure outside of the calibration range, adding a degree of unpredictability, and potentially causing malfunction, of the heat detector. For example, spontaneous and/or transient change in magnitude and/or direction of air movement in the immediate vicinity of the heat detection mechanism can cause spontaneous and/or transient spikes or dips in the enclosed volume internal gas pressure outside of the calibration range, possibly causing undesirable activation of the warning or alarm signal, falsely indicating a condition of excessive heat or fire.

Second, an open pneumatic non-electronic heat detector, is limited during conditions of very slow development of a condition of excessive heat or fire, during which the pneumatic non-electronic heat detection mechanism can self-calibrate or compensate itself to the slowly varying external conditions associated with the slowly developing excessive heat or fire. Accordingly, the pneumatic non-electronic heat detection mechanism may not distinguish the actual developing condition of excessive heat or fire from normally varying external environmental conditions. Such a realistic scenario can result in a slowly developing condition of excessive heat or fire going undetected, clearly leading to a hazardous situation.

Proper design and manufacturing of a heat detector according to established industry standards ordinarily includes a standard test procedure and additional heat detector components, mechanisms, and/or peripheral equipment for automatically testing the performance of the heat detection mechanism, and therefore, the heat detector. Automatically testing the performance of a pneumatic non-electronic heat detector is currently accomplished by using a separate electro-mechanical mechanism for artificially stimulating and causing actuation, for example, by increasing pneumatic pressure, of the mechanical mechanism of the heat detection mechanism, for effecting closure of the electrical contact, connection, switch, or electronic circuit, for activating a test warning or alarm signal indicating a test condition of excessive heat or fire.

Similar to limitations associated with normal operation of a pneumatic non-electronic heat detector, the standard automatic testing procedure is also limited by depending upon accurate and reliable functioning of the additional electro-mechanical mechanism, involving movement of a valve, switch, membrane, diaphragm, or similar actuatable device featuring one or more moving parts, as part of the artificial stimulus for increasing pneumatic pressure in the heat detector. Similarly, sufficient interference or failure in proper actuation or operation of the electro-mechanical mechanism during the automatic test procedure precludes proper functioning of the heat detection mechanism during the automatic test procedure. For example, a malfunctioning electro-mechanical mechanism can incorrectly effect closure of the electrical contact, connection, switch, or electronic circuit, for falsely activating a test warning or alarm signal, thereby falsely indicating a test condition of excessive heat or fire. This results in incorrectly, or falsely, determining proper performance of such a heat detector, leading to a potentially hazardous situation.

Another disadvantage of the current standard procedure for automatically testing the performance of a pneumatic non-electronic heat detector is that it involves artificially, not naturally, stimulating or causing actuation of the mechanical mechanism of the heat detection mechanism, for effecting closure of the electrical contact, connection, switch, or electronic circuit, for activating a test warning or alarm signal indicating a test condition of excessive heat or fire.

Artificially, and automatically, stimulating or causing actuation of the mechanical mechanism of a pneumatic non-electronic heat detection mechanism is typically done by using the previously mentioned electro-mechanical mechanism, provided in the heat detector at the time of its manufacture. Upon prompting the electro-mechanical mechanism by an end-user, such as by pushing a button or turning a switch of an electrical circuit, the electro-mechanical mechanism generates an increase in gas pressure in the enclosed volume of the heat detection mechanism sufficient to cause actuation of the mechanical mechanism of the heat detection mechanism, for effecting closure of the electrical contact, connection, switch, or electronic circuit, for activating a test warning or alarm signal indicating a test condition of excessive heat or fire.

In contrast, naturally stimulating or causing natural actuation of the mechanical mechanism of a pneumatic non-electronic heat detection mechanism would involve supplying sufficient heat or fire to the heat detection mechanism, thereby naturally increasing the gas pressure in the enclosed volume of the heat detection mechanism, causing actuation of the mechanical mechanism of the heat detection mechanism, for effecting closure of the electrical contact, connection, switch, or electronic circuit, for activating a test warning or alarm signal indicating a test condition of excessive heat or fire. Given the choice, a private user of a single heat detector, or, a fire prevention officer of a large facility having many heat detectors, would be expected to prefer subjecting a heat detector to test conditions as close as possible to actual conditions of excessive heat or fire, such as by naturally stimulating or causing natural actuation of the heat detection mechanism for indicating a test condition of excessive heat or fire.

A few prior art references featuring specific types of heat detectors described above are herein provided. Limitations associated with each heat detector device are only briefly listed here, with a more detailed understanding obtainable by referring to the above discussion.

In EP Patent No. 350440, issued to Securiton AG, a pressure surveillance device for a temperature detector is disclosed. Consistent with above described terminology, the device features an open pneumatic non-electronic line-type heat detection mechanism operating according to a rate of temperature rise. Warming of a sensor tube filled with air at a rate above a pre-determined threshold level causes actuation of a movable membrane for effecting closure of an electrical switch, followed by activation of a warning or alarm signal for indicating a condition of excessive heat or fire. A capillary tube is included in the device for enabling compensation of variations in internal gas pressure not related to a condition of excessive heat or fire. Automatic testing of the device is performed by using a bellows, a pressure sensor, a membrane switch, and a valve, for artificially causing actuation of the mechanical mechanism of the heat detector mechanism.

In U.S. Pat. No. 4,651,140, issued to Duggan, a fire detector is disclosed, which features an open pneumatic non-electronic heat detection mechanism. The heat detection mechanism can be operated as either a fixed temperature or a rate of temperature rise type, involving actuation of a moveable diaphragm for effecting closure of an electrical circuit, followed by activation of an alarm signal for indicating a condition of excessive heat or fire. A vent aperture is included in the device for enabling compensation of variations in internal gas pressure not related to a condition of excessive heat or fire.

Limitations of the heat detectors described in the preceding disclosures relate to the heat detection mechanism operating as open and non-electronic, including the need for actuating a movable membrane or diaphragm for closing an electrical switch. Moreover, the automatic testing procedure disclosed in EP Patent No. 350440, features artificial, not natural, actuation of the mechanical mechanism of the heat detector mechanism, and is further limited by requiring concerted movement of several mechanical components.

In U.S. Pat. No. 5,136,278, filed Mar. 15, 1991, by Watson et al., a pneumatic pressure detector for fire detection is disclosed, which features a closed pneumatic non-electronic line-type heat detection mechanism operating according to a fixed temperature. The heat detection mechanism features a closed capillary type sensor tube which has absorbed in it a gas. The gas expands upon an increase in temperature associated with a condition of excessive heat or fire, actuating a first deformable diaphragm for effecting closure of an electrical switch, followed by activation of an alarm signal. A low pressure activated switch and a second deformable diaphragm are included in the device for enabling compensation of a drop in internal gas pressure below a specified level. Limitations of the disclosed pressure detector relate to the heat detection mechanism operating as non-electronic, including the need for actuating the first deformable diaphragm for closing an electrical switch, and requiring concerted movement of the low pressure switch and the second deformable diaphragm for compensating a drop in internal gas pressure.

To one of ordinary skill in the art, there is thus a need for, and it would be highly advantageous to have a method for fluid pressure analytical electronic heat and fire detection, and a corresponding heat detector, used for detecting excessive heat and fire. Moreover, it would be highly advantageous to have such a method and corresponding heat detector featuring an analytical electronic heat detection mechanism having no moving component, such as a valve, switch, membrane, diaphragm, or similar actuatable device of one or more moving parts, for first analyzing a potential condition of excessive heat or fire, followed by logical and definitive determination of an actual condition of excessive heat or fire, for effecting activation of a warning or alarm signal indicating an actual condition of excessive heat or fire. Furthermore, it would be advantageous to be able to implement such a method and corresponding heat detector in a variety of applications, encompassing a wide range of environmental conditions, in a cost effective manner.

SUMMARY OF THE INVENTION

The present invention relates to a method for fluid pressure analytical electronic heat and fire detection, and a corresponding heat detector, used for detecting excessive heat and fire. The method for fluid pressure analytical electronic heat and fire detection, and corresponding heat detector, of the present invention, serve as significant improvements and overcome several limitations of currently used heat and fire detectors for detecting heat in general, and fire in particular.

A significant unique advantage of the present invention is that it features an analytical electronic heat detection mechanism having no moving component for effecting activation of a warning or alarm signal indicating a condition of excessive heat or fire. Moreover, the analytical electronic heat detection mechanism features electronic circuitry including a fluid pressure transducer and other electronic components, such as logic components, for highly accurately and reproducibly, first analyzing a potential condition, and then logically and definitively determining, an actual condition of excessive heat or fire, for example, by electronically monitoring and analyzing temperature and/or rate of temperature rise. This is in strong contrast to prior art electronic heat detection mechanisms featuring a single resistor or any other package of electronic components for causing activation of a warning or alarm signal, thereby indicating a condition of excessive heat or fire, incapable of first electronically analyzing a potential condition of excessive heat or fire, followed by logical and definitive determination of an actual condition of excessive heat or fire.

Another unique advantage is that the analytical electronic heat detection mechanism is fully functional when closed to any external source of fluid pressure, such as ambient atmosphere in the immediate vicinity of the heat detection mechanism, in contrast to prior art heat and fire detection mechanisms which are open to atmospheric pressure for enabling compensation of variations in internal gas pressure not related to a condition of excessive heat or fire.

Another unique advantage is that the automatic testing procedure is electronically performed, with no moving parts, and features naturally, not artificially, stimulating the analytical heat detection mechanism for effecting activation of a test warning or alarm signal indicating a test condition of excessive heat or fire.

A valuable benefit of the method and corresponding heat detector of the present invention is that they can be implemented in a variety of configurations, for example, spot type or line-type heat detectors, closed or open fluid pressure type heat detectors, operating according to different types, such as fixed temperature and/or rate of temperature rise, and, in a variety of applications, for example, by incorporating them into multi-unit systems of automatic fire detection, encompassing a wide range of environmental conditions, in a cost effective manner.

It is therefore an object of the present invention to provide a method for fluid pressure analytical electronic heat and fire detection for detecting excessive heat and fire.

It is another object of the present invention to provide a fluid pressure analytical electronic heat and fire detector for detecting excessive heat and fire.

It is a further object of the present invention to provide a method for fluid pressure analytical electronic heat and fire detection, and a corresponding heat detector, used for detecting excessive heat and fire, featuring an analytical electronic heat detection mechanism having no moving component, such as a valve, switch, membrane, diaphragm, or similar actuatable device of one or more moving parts, for effecting activation of a warning or alarm signal indicating a condition of excessive heat or fire.

It is yet a further object of the present invention to provide a method for fluid pressure analytical electronic heat and fire detection, and a corresponding heat detector, used for detecting excessive heat and fire, featuring an electronic heat detection mechanism either closed or open to an external source of fluid pressure, such as ambient atmosphere, in the immediate vicinity of the heat detection mechanism.

It is yet a further object of the present invention to provide a method for fluid pressure analytical electronic heat and fire detection, and a corresponding heat detector, used for detecting excessive heat and fire, featuring an electronic heat detection mechanism operating according to either a fixed temperature and/or a rate of temperature rise.

Thus, according to the present invention, there is provided a method for fluid pressure electronic heat and fire detection, comprising: (a) providing an enclosed volume and an internal fluid inside of the enclosed volume; (b) detecting and sensing a potential condition selected from the group consisting of excessive heat and fire by the internal fluid inside the enclosed volume; (c) increasing pressure of the internal fluid inside the enclosed volume in response to increasing temperature of the internal fluid due to the potential condition; (d) sensing and determining the pressure of the internal fluid inside the enclosed volume by at least one transducer; (e) converting the sensed and determined pressure into a transducer electrical signal; (f) sending the transducer electrical signal from the at least one transducer to an electronic circuit; (h) receiving and analyzing the transducer electrical signal by the electronic circuit; (i) sending an electrical signal selected from the group consisting of a warning signal and an alarm signal to a device by the electronic circuit following logical determination by the electronic circuit that the transducer electrical signal corresponds to an actual condition selected from the group consisting of excessive heat and fire; and (j) generating an indicating signal by the device, thereby indicating the actual condition selected from the group consisting of excessive heat and fire.

According to further features in preferred embodiments of the method described below, the enclosed volume includes at least two chambers for enclosing the internal fluid and at least one fluid flow restrictor for restricting flow of the internal fluid between the at least two chambers.

According to still further features in preferred embodiments of the method described below, the enclosed volume includes at least one fluid flow restrictor for enabling continuous communication between the enclosed volume of the internal fluid and an external source of fluid, thereby enabling automatic compensation and equilibration of the pressure of the internal fluid by pressure of the external source of fluid.

According to still further features in preferred embodiments of the method described below, at least one of the at least one transducer is a pressure transducer.

According to still further features in preferred embodiments of the method described below, the step of generating a pressure difference of the internal fluid between the at least two chambers is effected by the fluid flow restrictor positioned between the at least two chambers.

According to still further features in preferred embodiments of the method described below, the step of sensing and determining the pressure of the internal fluid by the at least one transducer includes the sensing and the determining the pressure difference of the internal fluid between the at least two chambers.

According to still further features in preferred embodiments of the method described below, the step of converting the sensed and the determined the pressure includes the converting the sensed and the determined pressure difference into the transducer electrical signal.

According to still further features in preferred embodiments of the method described below, the step of analyzing the transducer electrical signal by the electronic circuit includes performing signal analysis of the transducer electrical signal for logically and definitively determining if the potential condition is an actual condition selected from the group consisting of excessive heat and fire.

According to still further features in preferred embodiments of the method described below, the step of performing signal analysis includes performing waveform analysis and logical operations on the transducer electrical signal.

According to still further features in preferred embodiments of the method described below, the step of analyzing the transducer electrical signal by the electronic circuit is performed according to a type of operation of the electronic circuit, the type of operation is selected from the group consisting of fixed temperature, rate of temperature rise, and, fixed temperature and rate of temperature rise.

According to still further features in preferred embodiments of the method described below, the at least one transducer and the electronic circuit are used for electronically testing performance of the detector.

According to still further features in preferred embodiments of the method described below, the at least one transducer and the electronic circuit electronically communicate with a testing electronic circuit and an associated testing mechanism for performing the electronic testing of the detector.

According to still further features in preferred embodiments of the method described below, the associated testing mechanism includes a controllable heat generator for supplying a test condition of the excessive heat to the internal fluid inside the enclosed volume of the detector.

According to still further features in preferred embodiments of the method described below, a controllable heat generator supplying a test condition of the excessive heat to the internal fluid inside the enclosed volume of the detector is used for testing performance of the detector.

According to another aspect of the present invention, there is provided a fluid pressure electronic heat and fire detector, comprising: (a) an enclosed volume and an internal fluid inside of the enclosed volume, the internal fluid features variable pressure responsive to variations in temperature of the internal fluid, for detecting and sensing a potential condition selected from the group consisting of excessive heat and fire; (b) at least one transducer for sensing and determining the pressure of the internal fluid inside the enclosed volume, and for converting the sensed and determined pressure into a transducer electrical signal; (c) an electronic circuit for receiving and analyzing the transducer electrical signal sent by the at least one transducer, and for generating an electrical signal selected from the group consisting of a warning signal and an alarm signal following logically determining that the transducer electrical signal corresponds to an actual condition selected from the group consisting of excessive heat and fire; and (d) a device for receiving the electrical signal from the electronic circuit, and for generating an indicating signal, thereby indicating the actual condition selected from the group consisting of excessive heat and fire.

According to further features in preferred embodiments of the detector described below, the at least one chamber is configured for functioning in a type of heat detector selected from the group consisting of a line-type heat detector and a spot type heat detector.

According to still further features in preferred embodiments of the detector described below, the enclosed volume includes at least two chambers for enclosing the internal fluid and at least one fluid flow restrictor for restricting flow of the internal fluid between the at least two chambers.

According to still further features in preferred embodiments of the detector described below, the enclosed volume includes at least one fluid flow restrictor for enabling continuous communication between the enclosed volume of the internal fluid and an external source of fluid, thereby enabling automatic compensation and equilibration of the pressure of the internal fluid by pressure of the external source of fluid.

According to still further features in preferred embodiments of the detector described below, the at least one of the at least one transducer is a pressure transducer.

According to still further features in preferred embodiments of the detector described below, the at least one transducer senses and determines a pressure difference of the internal fluid generated between the at least two chambers effected by the fluid flow restrictor positioned between the at least two chambers.

According to still further features in preferred embodiments of the detector described below, the at least one transducer converts the sensed and the determined pressure difference into the transducer electrical signal.

According to still further features in preferred embodiments of the detector described below, the electronic circuit analyzes the transducer electrical signal by performing signal analysis of the transducer electrical signal for logically and definitively determining if the potential condition is an actual condition selected from the group consisting of excessive heat and fire.

According to still further features in preferred embodiments of the detector described below, the electronic circuit performs signal analysis by performing waveform analysis and logical operations on the transducer electrical signal.

According to still further features in preferred embodiments of the detector described below, the electronic circuit analyzes the transducer electrical signal according to a type of operation of the electronic circuit, the type of operation is selected from the group consisting of fixed temperature, rate of temperature rise, and, fixed temperature and rate of temperature rise.

According to still further features in preferred embodiments of the detector described below, the at least one transducer and the electronic circuit are used for electronically testing performance of the detector.

According to still further features in preferred embodiments of the detector described below, the at least one transducer and the electronic circuit electronically communicate with a testing electronic circuit and an associated testing mechanism for performing the electronic testing of the detector.

According to still further features in preferred embodiments of the detector described below, the associated testing mechanism includes a controllable heat generator for supplying a test condition of the excessive heat to the internal fluid inside the enclosed volume of the detector.

According to still further features in preferred embodiments of the detector described below, the method for electronically testing the performance of the fluid pressure electronic heat and fire detector comprises: (a) subjecting the internal fluid inside the enclosed volume to a test condition selected from the group consisting of excessive heat and fire; (b) detecting and sensing the test condition by the internal fluid inside the enclosed volume; (c) increasing pressure of the internal fluid inside the enclosed volume in response to increasing temperature of the internal fluid due to the test condition; (d) sensing and determining said pressure of said internal fluid inside said enclosed volume by said at least one transducer; (e) converting said sensed and determined pressure into a transducer electrical signal; (f) sending said transducer electrical signal from said at least one transducer to said electronic circuit; (h) receiving and analyzing said transducer electrical signal by said electronic circuit; (i) sending an electrical signal selected from the group consisting of a warning signal and an alarm signal to said device by said electronic circuit following logical determination by said electronic circuit that said transducer electrical signal corresponds to an actual condition selected from the group consisting of excessive heat and fire; and (j) generating an indicating signal by said device, thereby indicating said actual condition selected from the group consisting of excessive heat and fire.

According to still further features in preferred embodiments of the detector described below, the step of subjecting said internal fluid inside said enclosed volume to said test condition is effected by a testing mechanism selected from the group consisting of a manual testing mechanism and an automatic testing mechanism, said automatic testing mechanism is selected from the group consisting of an electrical automatic testing mechanism and an electronic automatic testing mechanism.

According to still further features in preferred embodiments of the detector described below, the testing mechanism includes a controllable heat generator.

According to another aspect of the present invention, there is provided a method for testing the performance of a fluid pressure detector selected from the group consisting of a heat detector, a fire detector, and, a heat and fire detector, comprising: (a) heating internal fluid inside enclosed volume of the detector to a test condition of excessive heat, whereby said heating is effected by a controllable heat generator; (b) detecting and sensing said test condition by said internal fluid inside said enclosed volume; (c) increasing pressure of said internal fluid inside said enclosed volume in response to increasing temperature of said internal fluid due to said test condition; (d) sensing said pressure of said internal fluid inside said enclosed volume by a fluid pressure sensing mechanism; (e) activating a circuit in response to said sensed pressure; (f) sending a signal selected from the group consisting of a warning signal and an alarm signal to a device by said circuit; and (g) generating an indicating signal by said device, thereby indicating said test condition of excessive heat.

According to further features in preferred embodiments of the testing method described below, the controllable heat generator is controlled by a testing mechanism selected from the group consisting of a manual testing mechanism and an automatic testing mechanism, said automatic testing mechanism is selected from the group consisting of an electrical automatic testing mechanism and an electronic automatic testing mechanism.

According to still further features in preferred embodiments of the testing method described below, the fluid pressure sensing mechanism is selected from the group consisting of a non-electronic fluid pressure sensing mechanism and an electronic fluid pressure sensing mechanism.

According to further features in preferred embodiments of the testing method described below, the electronic fluid pressure sensing mechanism includes at least one transducer for converting said sensed pressure into an electrical signal.

According to further features in preferred embodiments of the testing method described below, the step of activating a circuit is performed in a mode selected from the group consisting of non-electronic activation and electronic activation, and whereby said circuit is selected from the group consisting of a non-electronic circuit and an electronic circuit.

According to further features in preferred embodiments of the testing method described below, the method is applicable for incorporation into a system for automatic detection selected from the group consisting of automatic heat detection, automatic fire detection, and, automatic heat and fire detection.

BRIEF DESCRIPTION OF THE DRAWINGS

The invention is herein described, by way of example only, with reference to the accompanying drawing, wherein.

DESCRIPTION OF THE PREFERRED EMBODIMENTS

Figure 1:
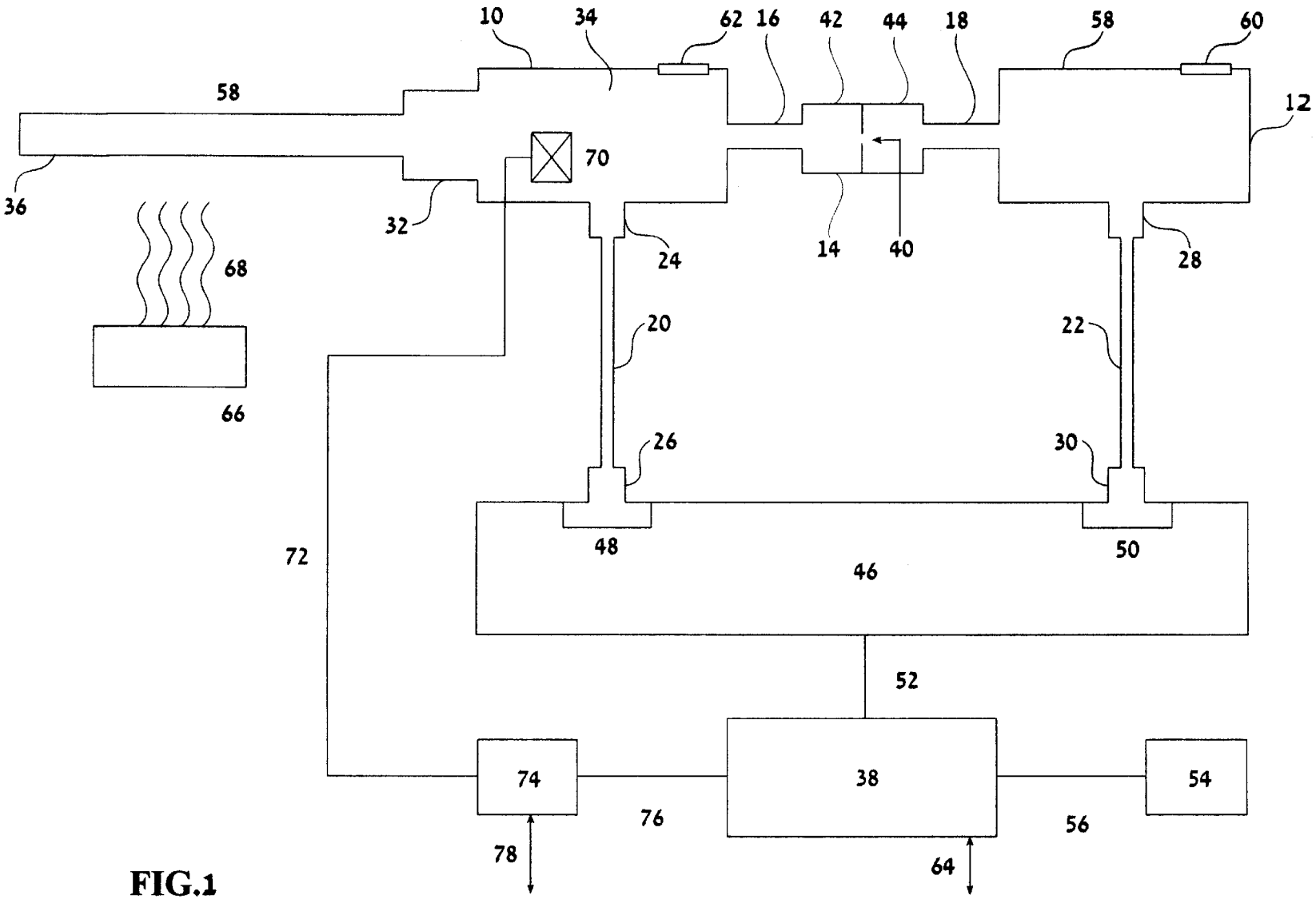
FIG. 1 is a schematic diagram illustrating preferred embodiments of the fluid pressure analytical electronic heat detector, featuring configurations of spot type and line-type, operating with either a closed or an open heat detection mechanism, in accordance with the present invention.

The present invention relates to a method for fluid pressure analytical electronic heat and fire detection, and a corresponding heat detector, used for detecting excessive heat and fire.

The present invention features a unique method, and a corresponding heat detector, having no moving component, such as a valve, switch, membrane, diaphragm, or similar actuatable device of one or more moving parts, for effecting activation of a warning or alarm signal indicating a condition of excessive heat or fire. Moreover, the analytical electronic heat detection mechanism features electronic circuitry which includes at least one fluid pressure transducer and several other cooperatively functioning electronic components, such as logic components, for highly accurately and reproducibly, first analyzing a potential condition, and then logically and definitively determining, an actual condition of excessive heat or fire, for example, by electronically monitoring and analyzing temperature and/or rate of temperature rise. This is in strong contrast to prior art electronic heat detection mechanisms featuring a single resistor or any other package of electronic components for causing activation of a warning or alarm signal, thereby indicating a condition of excessive heat or fire, without first electronically analyzing a potential condition of excessive heat or fire, followed by logical and definitive determination of an actual condition of excessive heat or fire.

Another unique feature is that the fluid pressure analytical electronic heat detection mechanism is fully functional, by having at least one fluid chamber closed to any external source of fluid pressure, such as ambient atmosphere in the immediate vicinity of the heat detection mechanism, in contrast to prior art heat and fire detection mechanisms which are open to atmospheric pressure for enabling compensation of variations in internal gas pressure not related to a condition of excessive heat or fire.

Another unique feature is that the automatic testing procedure is electronically performed, with no moving parts, and features naturally, not artificially, stimulating the analytical heat detection mechanism for effecting activation of a test warning or alarm signal indicating a test condition of excessive heat or fire.

Moreover, the method and corresponding heat detector of the present invention can be implemented in a variety of configurations, for example, spot type or line-type heat detectors, closed or open fluid pressure type heat detectors, operating in different ways for monitoring temperature, such as fixed temperature and/or rate of temperature rise, and, in a variety of applications, for example, by incorporating them into multi-unit systems of automatic fire detection, encompassing a wide range of environmental conditions, in a cost effective manner.

It is to be understood that the invention is not limited in its application to the details of the method and corresponding heat detector device set forth in the following description and drawings. The invention is capable of other embodiments or of being practiced or carried out in various ways. For example, the following description refers to a gas as the preferred fluid, in order to illustrate implementation of the present invention, but a liquid exhibiting the proper properties and characteristics can also be used for implementation. It is to be understood that the phraseology and terminology employed herein are for the purpose of description and should not be regarded as limiting.

Steps, components, operation, and implementation of a method for fluid pressure analytical electronic heat and fire detection, and a corresponding heat detector, used for detecting heat in general, and fire in particular, according to the present invention, are better understood with reference to the following description and accompanying drawings.

Two sets of two preferred embodiments of the method, along with corresponding preferred embodiments of the heat detector, of the present invention, are herein described. The first set of preferred embodiments of the method, and of the corresponding heat detector, relates to either a line-type or a spot type configuration, where each configuration features a closed heat detection mechanism, whereby an enclosed volume of fluid can be maintained in a pressurized state, normally closed to any external source of fluid. The second set of preferred embodiments of the method, and of the corresponding heat detector, relates to a similar line-type or spot type configuration of the first set, but, here, each configuration features an open heat detection mechanism, whereby an enclosed volume of fluid is in continuous communication with an external source of fluid, such as ambient atmosphere. For each preferred embodiment, the heat detection mechanism has the capability of operating in different ways for monitoring temperature, such as fixed temperature and/or rate of temperature rise. FIG. 1 is a schematic diagram illustrating each of the alternative preferred embodiments of the fluid pressure analytical electronic heat detector.

The first set of two preferred embodiments of the method and corresponding heat detector, for fluid pressure analytical electronic heat and fire detection are herein described.

In Step 1, there is provided an enclosed volume and an internal fluid inside of the enclosed volume, where the enclosed volume includes at least one chamber, at least one fluid flow restrictor when using an enclosed volume including more than one chamber, and a plurality of connectors and connections, enabling fluid flow to enter and exit the at least one chamber, and the at least one fluid flow restrictor.

As shown in FIG. 1, preferably, the enclosed volume includes two separate, but interconnected, chambers 10 and 12 (excluding components 60 and 62, which relate only to the second set of preferred embodiments of the method and detector), a fluid flow restrictor 14 connecting the two chambers 10 and 12, and a plurality of connectors 16, 18, 20, and 22, and connections 24, 26, 28, and 30, enabling fluid flow to enter and exit each chamber 10 and 12 and fluid flow restrictor 14.

The first of the two chambers, chamber 10, features an exposed part 32, for sensing heat or fire present in the ambient environment, and a remaining non-exposed part 34. For a line-type configuration heat detector, exposed part 32 protrudes from non-exposed part 34, and is preferably elongated and configured as a tube 36. Tube 36 may be made of any material appropriate for sensing excessive heat or fire, such as rigid or flexible metal. For a spot type configuration heat detector, exposed part 32 preferably protrudes only slightly from non-exposed part 34. Each of the line-type configuration and of the spot type configuration of the method features a closed heat detection mechanism, whereby the enclosed volume of internal fluid can be maintained in a pressurized state, normally closed to an external source of fluid, and is therefore uninfluenced by pressure variations of an external source of fluid, for example, pressure variations of the ambient atmosphere.

The enclosed internal fluid (not shown) is preferably a pure gas such as hydrogen or nitrogen, but may also be a gas mixture such as hydrogen and an inert gas such as helium or argon. The enclosed internal fluid may also be a liquid which exhibits the proper physicochemical properties and characteristics, such as having the ability to sufficiently increase in pressure at a sufficient rate in response to sensing heat or fire, necessary for cooperative operation of other components of the analytical electronic heat detection mechanism.

In Step 2, there is sensing of a potential condition of excessive heat or fire by the internal fluid enclosed in tube 36 for a line-type configuration, or, in exposed part 32 for a spot type configuration, of first chamber 10. The level of heat that is considered as excessive heat or fire is determined by adjustment and calibration of the electronic circuit 38 of the heat detector.

In Step 3, there is increasing the pressure of the internal fluid enclosed in exposed part 36 for a line-type configuration, or, in exposed part 32 for a spot type configuration, of first chamber 10, immediately followed by increasing pressure of the internal fluid enclosed in remaining non-exposed part 34 of first chamber 10, caused by increasing temperature of the internal fluid, as a result of the sensing of a potential condition of excessive heat or fire. The magnitude and rate of the increasing pressure of the internal fluid are proportional to the magnitude and rate of sensing excessive heat or fire by the internal fluid, respectively.

In Step 4, there is generating a pressure difference of the internal fluid between first chamber 10 and second chamber 12, effected by the presence of a fluid flow restrictor 14 positioned between the two chambers, when using an enclosed volume including two chambers 10 and 12. Fluid flow restrictor 14 typically features an orifice 40 or equivalent element positioned between fluid flow restrictor chambers 42 and 44, for restricting fluid flow from first chamber to second chamber 12. The magnitude and rate of generating the pressure difference of the internal fluid are proportional to the magnitude and rate of the increasing pressure of the internal fluid, respectively. When using an enclosed volume including a single chamber 10, no pressure difference is generated, and the method continues with the next step.

In Step 5, there is sensing and determining the pressure of the internal fluid inside chamber 10 by at least one transducer 46, preferably, a pressure transducer, when using an enclosed volume including a single chamber 10. Preferably, there is sensing and determining the pressure difference of the internal fluid between chambers 10 and 12 by at least one pressure transducer 46, preferably, a differential pressure transducer, when using an enclosed volume including two chambers 10 and 12.

When using an enclosed volume including two chambers 10 and 12, along with using one transducer 46, transducer 46 has at least two input ports 48 and 50, where one input port 48 is connected to first chamber 10, via connector 20 and, connections 24 and 26, preferably to non-exposed part 34 of first chamber 10, for sensing and determining the pressure of the internal fluid inside first chamber 10, and, a second input port 50 is connected to second chamber 12, via connector 22 and, connections 28 and 30, for sensing and determining the pressure of the internal fluid inside second chamber 12. Magnitude and rate of sensing the increasing pressure difference are proportional to the magnitude and rate of generating the pressure difference.

Alternatively, when using an enclosed volume including two chambers, along with using two separate transducers (not shown), each transducer has at least one input port. First chamber 10 is connected to an input port of the first transducer, for sensing and determining internal fluid pressure inside first chamber 10, and second chamber 12 is connected to an input port of the second transducer, for sensing and determining internal fluid pressure inside second chamber 12. An appropriate electronic component is connected to each of the two separate transducers, in order to enable determining the pressure difference of the internal fluid between chambers 10 and 12.

In Step 6, there is converting the sensed and determined pressure, preferably, pressure difference, into a transducer electrical signal, such as a voltage or a current, preferably a voltage, by transducer 46. Magnitude and rate of converting the sensed and determined pressure, preferably, pressure difference, are proportional to the magnitude and rate of sensing and determining the pressure, preferably, pressure difference, respectively.

In Step 7, there is sending the transducer electrical signal from transducer 46 to an electronic circuit 38, preferably an analytical electronic circuit 38, via signal line 52. Magnitude and rate of sending the transducer electrical signal are proportional to the magnitude and rate of converting the sensed and determined pressure, preferably, pressure difference.

In Step 8, there is receiving and analyzing the transducer electrical signal by analytical electronic circuit 38. At this stage of heat detector operation, the transducer electrical signal corresponds only to a potential condition of excessive heat or fire. Analytical electronic circuit 38 performs signal analysis of the transducer electrical signal in order to logically and definitively determine if the potential condition of excessive heat or fire is an actual condition of excessive heat or fire.

Signal analysis of the transducer electrical signal includes, for example, performing waveform analysis and logical operations on the transducer electrical signal. Moreover, signal analysis is performed according to the particular type of operation of the electronic heat detection mechanism, such as according to fixed temperature and/or according to rate of temperature rise. Analytical electronic circuit 38 logically determines the status of the potential condition of excessive heat or fire by requiring results of the signal analysis of the transducer electrical signal to fulfill one or both sets of conditions corresponding to fixed temperature criteria or/and rate of temperature rise criteria, respectively.

Specifically, in the case of the heat detection mechanism operating according to fixed temperature, analytical electronic circuit 38 determines if the transducer electrical signal corresponds to a pre-determined threshold level corresponding to a fixed temperature indicating excessive heat or fire. Similarly, in the case of the heat detection mechanism operating according to rate of temperature rise, analytical electronic circuit 38 determines if the transducer electrical signal corresponds to a pre-determined threshold level corresponding to rate of temperature rise indicating excessive heat or fire. In the case of the heat detection mechanism operating according to both fixed temperature and rate of temperature rise, analytical electronic circuit 38 determines if both criteria of re-determined threshold levels are fulfilled by the transducer electrical signal.

In the case that analytical electronic circuit 38 logically determines that the transducer electrical signal does not correspond to an actual condition of excessive heat or fire, analytical electronic circuit 38 continues normal monitoring and analysis of the internal fluid pressure either in chamber 10, when using an enclosed volume including a single chamber, or, preferably, in chambers 10 and 12, when using an enclosed volume including two chambers, and the heat detector continues normal monitoring of the ambient environment for a condition of excessive heat or fire.

In Step 9, there is sending a warning or alarm electrical signal to an electrical or electronic warning or alarm device 54 by analytical electronic circuit 38, via signal line 56, following logical determination by analytical electronic circuit 38 that the transducer electrical signal corresponds to an actual condition of excessive heat or fire.

In Step 10, there is generating an indicating signal by warning or alarm device 54, thereby indicating the actual condition of excessive heat or fire. The indicating signal can be of variable form, such as an audio signal, a visual signal, both an audio and a visual signal, or some other type of electrical indicating signal.

The second set of alternative preferred embodiments of the method and corresponding heat detector, for fluid pressure analytical electronic heat and fire detection are herein described, with reference to FIG. 1. These embodiments are similar to the first set of respective preferred embodiments, but differ from the first set of embodiments by operating with an open heat detection mechanism, including the presence of a fluid flow restrictor specifically for enabling automatic compensation and equilibration of the internal fluid pressure by an external source of fluid.

In Step 1, there is provided a partially enclosed volume and an internal fluid inside of the partially enclosed volume, where the partially enclosed volume includes at least one chamber, at least one fluid flow restrictor when the partially enclosed volume includes at least one chamber, or, at least two fluid flow restrictors when the partially enclosed volume includes more than one chamber, and a plurality of connectors and connections, enabling fluid flow to enter and exit the at least one chamber, and the at least one fluid flow restrictor.

As shown in FIG. 1, preferably, there is provided a partially enclosed volume including two separate, but interconnected, chambers 10 and 12, a first fluid flow restrictor 14 connecting the two chambers 10 and 12, and a plurality of connectors 16, 18, 20, and 22, and connections 24, 26, 28, and 30, enabling fluid flow to enter and exit each chamber and first fluid flow restrictor 14.

The first of the two chambers, chamber 10, features an exposed part 32, for sensing heat or fire present in the ambient environment, and a remaining non-exposed part 34. For a line-type configuration heat detector, exposed part 32 protrudes from non-exposed part 34, and is preferably elongated and configured as a tube 36. Tube 36 may be made of any material appropriate for sensing excessive heat or fire, such as rigid or flexible metal. For a spot type configuration heat detector, exposed part 32 preferably protrudes only slightly from non-exposed part 34.

The partially enclosed internal fluid is preferably ambient atmosphere, but, in principle, may be any other ambient fluid in the vicinity of the heat detector, such as a pure gas, gas mixture, or liquid, forming the ambient environment of the heat detector. Each of the line-type configuration and of the spot type configuration of this preferred embodiment of the method features an open heat detection mechanism, whereby the partially enclosed volume of internal fluid is normally open to an external source of fluid 58 at a location along second chamber 12 of the two chambers 10 and 12.

When using a partially enclosed volume featuring two chambers 10 and 12, second chamber 12 features at least one fluid flow restrictor located along its perimeter, preferably one fluid flow restrictor, herein referenced as second fluid flow restrictor 60. Second fluid flow restrictor 60 features one side connected to second chamber 12, and a second side exposed to external source of fluid 58, preferably, ambient atmosphere. Second fluid flow restrictor 60 enables continuous communication between the partially enclosed volume of internal fluid and external source of fluid 60, for enabling automatic compensation and equilibration of the internal fluid pressure by external source of fluid 58.

When using a partially enclosed volume featuring one chamber 10, chamber 10 features at least one fluid flow restrictor located along its perimeter, preferably one fluid flow restrictor, referenced as fluid flow restrictor 62. Fluid flow restrictor 62 features one side connected to chamber 10, and a second side exposed to external source of fluid 58, preferably, ambient atmosphere. Fluid flow restrictor 62 enables continuous communication between the partially enclosed volume of internal fluid and external source of fluid 58, for enabling automatic compensation and equilibration of the internal fluid pressure by external source of fluid 58.

In Step 2, there is sensing of a potential condition of excessive heat or fire by the fluid enclosed in tube 36 for a line-type configuration, or, in exposed part 32 for a spot type configuration, of first chamber 10. The level of heat that is considered as excessive heat or fire is determined by adjustment and calibration of the electronic circuit 38 of the heat detector.

In Step 3, there is increasing the pressure of the internal fluid enclosed in exposed part 36, for a line-type configuration, or, in exposed part 32, for a spot type configuration, of first chamber 10, immediately followed by increasing pressure of the fluid enclosed in remaining non-exposed part 34 of first chamber 10, caused by increasing temperature of the internal fluid, as a result of the sensing of a potential condition of excessive heat or fire.

In Step 4, there is generating a pressure difference of the internal fluid between first chamber 10 and second chamber 12, effected by the presence of first fluid flow restrictor 14 positioned between the two chambers, when using an enclosed volume including two chambers 10 and 12. When using an enclosed volume featuring a single chamber 10, no pressure difference is generated, and the method continues with the next step.

In Step 5, there is sensing and determining the pressure of the internal fluid inside chamber 10 by at least one transducer 46, preferably, a pressure transducer, via connector 20 and, connections 24 and 26, when using an enclosed volume including a single chamber 10. Preferably, there is sensing and determining the pressure difference of the internal fluid between chambers 10 and 12 by at least one pressure transducer 46, preferably, a differential pressure transducer, when using an enclosed volume including two chambers 10 and 12.

When using an enclosed volume featuring two chambers 10 and 12, along with using one transducer 46, transducer 46 has at least two input ports 48 and 50, where one input port 48 is connected to first chamber 10, preferably to non-exposed part 34 of first chamber 10, via connector 20 and, connections 24 and 26, for sensing and determining the pressure of the internal fluid inside first chamber 10, and, a second input port 50 is connected to second chamber 12, via connector 22 and, connections 28 and 30, for sensing and determining pressure of the internal fluid inside second chamber 12.

Alternatively, when using an enclosed volume featuring two chambers, along with using two separate transducers (not shown), each transducer has at least one input port. First chamber 10 is connected to an input port of the first transducer, for sensing and determining internal fluid pressure inside first chamber 10, and second chamber 12 is connected to an input port of the second transducer, for sensing and determining internal fluid pressure inside second chamber 12. An appropriate electronic component is connected to each of the two separate transducers, in order to enable determining the pressure difference of the internal fluid between chambers 10 and 12.

In Step 6, there is converting the sensed and determined pressure, preferably, pressure difference, into a transducer electrical signal, such as a voltage or a current, preferably a voltage, by transducer 46.

In Step 7, there is sending the transducer electrical signal from transducer 46 to an electronic circuit 38, preferably, an analytical electronic circuit 38, via signal line 52.

In Step 8, there is receiving and analyzing the transducer electrical signal by analytical electronic circuit 38. At this stage of heat detector operation, the transducer electrical signal corresponds only to a potential condition of excessive heat or fire. Analytical electronic circuit 38 performs signal analysis of the transducer electrical signal in order to logically and definitively determine if the potential condition of excessive heat or fire is an actual condition of excessive heat or fire.

Signal analysis of the transducer electrical signal includes, for example, performing waveform analysis and logical operations on the transducer electrical signal. Moreover, signal analysis is performed according to the particular type of operation of the electronic heat detection mechanism, such as according to rate of temperature rise. Analytical electronic circuit 38 logically determines the status of the potential condition of excessive heat or fire by requiring results of the signal analysis of the transducer electrical signal to fulfill rate of temperature rise criteria.

In the case that analytical electronic circuit 38 logically determines that the transducer electrical signal does not correspond to an actual condition of excessive heat or fire, analytical electronic circuit 38 continues normal monitoring and analysis of the internal fluid pressure either in chamber 10, when using an enclosed volume including a single chamber, or, preferably, in chambers 10 and 12, when using an enclosed volume including two chambers, and the heat detector continues normal monitoring of the ambient environment for a condition of excessive heat or fire.

In Step 9, there is sending a warning or alarm electrical signal to an electrical or electronic warning or alarm device 54 by analytical electronic circuit 38, via signal line 56 following logical determination by analytical electronic circuit 38 that the transducer electrical signal corresponds to an actual condition of excessive heat or fire.

In Step 10, there is generating an indicating signal by warning or alarm device 54, thereby indicating the actual condition of excessive heat or fire. The indicating signal can be of variable form, such as an audio signal, a visual signal, both an audio and a visual signal, or some other type of electrical indicating signal.

Each of the above described preferred embodiments of the method, and corresponding heat detector, of the present invention, can be implemented in a variety of applications, for example, by incorporation into a multi-unit system (not shown) of automatic excessive heat or fire detection, for example, via control/data links 64 (FIG. 1), encompassing a wide range of environmental conditions, in a cost effective manner.

Two preferred procedures for electronically testing the performance of the fluid pressure electronic heat detector of the present invention are herein described. Two particular objectives of performing the electronic testing procedure are (i) to determine that the enclosed volume is not damaged, and (ii) to determine that each of the electronic components, for example, the transducer, electronic circuit, and warning or alarm device, is properly performing.

Each testing procedure is applicable to, and includes operation of, each preferred embodiment of the disclosed method and corresponding heat detector. The first testing procedure is primarily for implementing in applications where the heat detector is physically located within reasonable reach by a person, for example, in private homes or small businesses. The second testing procedure is primarily for implementing in applications where the heat detector is physically located out of reach by a person, for example, commercial, military, or other applications requiring the heat detector to be out of reach by a person.

Each electronic testing procedure features enables simulating normal operation of the heat detector for detecting and responding to a condition of excessive heat or fire. This simulation is accomplished by naturally stimulating the heat detection mechanism by including a controllable test source of excessive heat or fire, causing automatic response by the analytical electronic circuit for effecting indication of a condition of excessive heat or fire.

Referring again to FIG. 1, the first procedure for electronically testing the performance of the heat detector is initiated by subjecting tube 36, for a line-type configuration, or, exposed part 32, for a spot type configuration, of first chamber 10 to a device 66 providing excessive heat or fire 68. For example, a controllable heat generator, torch or lighter, or similar functioning device capable of providing heat or fire, is positioned, manually or automatically, in the immediate vicinity of tube 36 or exposed part 32, for stimulating and causing the sensing of a test condition of excessive heat or fire by the internal fluid enclosed in exposed part 36 or 32 of first chamber 10. Continuation and completion of this electronic test procedure are accomplished by performing Step 2 through Step 10, according to the above described embodiments of the method and corresponding heat detector.

Alternatively, a second procedure for electronically testing the performance of the heat detector may be implemented, which is completely automatic by including a mechanism for automatically, naturally stimulating the heat detection mechanism. This is done by including an automatic controllable test source of excessive heat, causing automatic response by the analytical electronic circuit for effecting indication of a condition of excessive heat or fire.

Referring again to FIG. 1, the second procedure for electronically testing the performance of the heat detector is initiated by subjecting the internal fluid inside non-exposed part 34 of first chamber 10, of either a line-type configuration, or, a spot type configuration, to a controllable test source of excessive heat provided by an electronically controllable heat generator 70, for stimulating and causing the sensing of a test condition of excessive heat or fire by the internal fluid enclosed in non-exposed part 34 of first chamber 10.

In particular, a heat generator 70 is physically located inside of non-exposed part 34 of first chamber 10, and is electronically controllable, via control line 72, by an electronic circuit, for example, testing electronic circuit 74. Testing electronic circuit 74 is in electronic communication with analytical electronic circuit 38 via control/data links 76.

Analytical electronic circuit 38 is used for activating testing electronic circuit 74, or, alternatively, a multi-unit system (not shown) of automatic excessive heat or fire detection in electronic communication with testing electronic circuit 74, via control/data links 78, is used for activating testing electronic circuit 74, for initiating and monitoring the automatic testing procedure. This is accomplished, for example, by pushing a button or turning a switch, included in either analytical electronic circuit 38, or, in a component of the multi-unit system. Continuation and completion of this electronic test procedure are accomplished by performing Step 2 through Step 10, according to the above described embodiments of the method and corresponding heat detector.

An optional feature of the second automatic testing procedure, involves activating a test indicating signal, such as a visual or audio test indicating signal, for example, a flickering LED light, simultaneously to initiating the automatic testing procedure by pushing a button or turning a switch provided in analytical electronic circuit 38, or, in a component of the multi-unit detection system. Activation of the test indicating signal serves to inform an end-user that the automatic testing procedure has been initiated, and that the heat detector is in a testing mode. Completion of the testing procedure, whereby the heat detector is properly operational, is indicated by deactivation of the test indicating signal, for example, discontinuation of the flickering LED light. Completion of the testing procedure, whereby the heat detector malfunctions, or, is non-functional, is indicated by continued activation of the test indicating signal, for example, continuation of the flickering LED light.

An end-user uses the results of either automatic testing procedure to determine if the heat detector can be returned to normal operation, or, if additional testing and/or troubleshooting of the heat detector is necessary.

The above described automatic testing procedures are generally applicable for testing the performance of heat and fire detectors featuring a variety of configurations, including, spot type or line-type heat and fire detectors, closed or open fluid pressure type heat and fire detectors, operating in different ways for monitoring temperature, such as fixed temperature and/or rate of temperature rise, and, in a variety of applications, including incorporating them into multi-unit systems of automatic excessive heat and fire detection, encompassing a wide range of environmental conditions, in a cost effective manner.

In particular, transducer 46 and electronic circuit 38 can be used for electronically testing the performance of a given configuration of a heat or fire detector. Transducer 46 and electronic circuit 38 electronically communicate with testing electronic circuit 74, which can be configured for electronically communicating with an associated testing mechanism for performing the electronic performance testing of the heat or fire detector. For example, the associated testing mechanism could include controllable heat generator 70 for supplying a test condition of excessive heat to internal fluid inside enclosed volume of the heat or fire detector.

Alternatively, controllable heat generator 70 can be used for supplying a test condition of excessive heat to internal fluid inside enclosed volume of a heat or fire detector, for testing the performance of the detector, by using a differently configured and operating electronic, or non-electronic electrical circuit, without including testing electronic circuit 74, electronic circuit 38, and transducer 46.

While the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A method for fluid pressure electronic heat and fire detection, comprising:

(a) providing an enclosed volume and an internal fluid inside of said enclosed volume;

(b) detecting and sensing a potential condition selected from the group consisting of excessive heat and fire by said internal fluid inside said enclosed volume;

(c) increasing pressure of said internal fluid inside said enclosed volume in response to increasing temperature of said internal fluid due to said potential condition;

(d) sensing and determining said pressure of said internal fluid inside said enclosed volume by at least one transducer;

(e) converting said sensed and determined pressure into a transducer electrical signal;

(f) sending said transducer electrical signal from said at least one transducer to an electronic circuit;

(h) receiving and analyzing said transducer electrical signal by said electronic circuit;

(i) sending an electrical signal selected from the group consisting of a warning signal and an alarm signal to a device by said electronic circuit following logical determination by said electronic circuit that said transducer electrical signal corresponds to an actual condition selected from the group consisting of excessive heat and fire; and (j) generating an indicating signal by said device, thereby indicating said actual condition selected from the group consisting of excessive heat and fire.

2. The method of claim 1, wherein said enclosed volume is selected from the group consisting of being closed to an external source of fluid and being open to an external source of fluid.

3. The method of claim 1, wherein said enclosed volume includes at least one chamber for enclosing said internal fluid.

4. The method of claim 3, wherein said at least one chamber is configured for functioning in a type of heat detector selected from the group consisting of a line-type heat detector and a spot type heat detector.

5. The method of claim 3, wherein said at least one chamber includes an exposed part and a non-exposed part, said exposed part is for said detecting and said sensing of said potential condition by said internal fluid inside said enclosed volume.

6. The method of claim 1, wherein said enclosed volume includes at least two chambers for enclosing said internal fluid and at least one fluid flow restrictor for restricting flow of said internal fluid between said at least two chambers.

7. The method of claim 1, wherein said enclosed volume includes at least one fluid flow restrictor for enabling continuous communication between said enclosed volume of said internal fluid and an external source of fluid, thereby enabling automatic compensation and equilibration of said pressure of said internal fluid by pressure of said external source of fluid.

8. The method of claim 1, wherein said internal fluid is selected from the group consisting of a gas and a liquid, said gas is selected from the group consisting of hydrogen, nitrogen, an inert gas, and ambient atmosphere.

9. The method of claim 1, wherein level of heat considered as said excessive heat is determined by adjustment and calibration of said electronic circuit.

10. The method of claim 1, wherein at least one of said at least one transducer is a pressure transducer.

11. The method of claim 6, further comprising the step of generating a pressure difference of said internal fluid between said at least two chambers is effected by said fluid flow restrictor positioned between said at least two chambers.

12. The method of claim 11, wherein the step of sensing and determining said pressure of said internal fluid by said at least one transducer includes said sensing and said determining said pressure difference of said internal fluid between said at least two chambers.

13. The method of claim 12, wherein the step of converting said sensed and said determined said pressure includes said converting said sensed and said determined said pressure difference into said transducer electrical signal.

14. The method of claim 1, wherein said transducer electrical signal is selected from the group consisting of a voltage signal and a current signal.

15. The method of claim 1, wherein the step of analyzing said transducer electrical signal by said electronic circuit includes performing signal analysis of said transducer electrical signal for logically and definitively determining if said potential condition is an actual condition selected from the group consisting of excessive heat and fire.

16. The method of claim 15, wherein the step of performing signal analysis includes performing waveform analysis and logical operations on said transducer electrical signal.

17. The method of claim 1, wherein the step of analyzing said transducer electrical signal by said electronic circuit is performed according to a type of operation of said electronic circuit, said type of operation is selected from the group consisting of fixed temperature, rate of temperature rise, and, fixed temperature and rate of temperature rise.

18. The method of claim 17, wherein said electronic circuit makes a determination selected from the group consisting of said transducer electrical signal corresponds to a pre-determined threshold level corresponding to a fixed temperature indicating a condition selected from the group consisting of excessive heat and fire, said transducer electrical signal corresponds to a pre-determined threshold level corresponding to a rate of temperature rise indicating said condition, and, said transducer electrical signal corresponds to a pre-determined threshold level corresponding to said fixed temperature and said transducer signal corresponds to a pre-determined threshold level corresponding to said rate of temperature rise.

19. The method of claim 1, wherein said device for receiving said electrical signal from said electronic circuit is selected from the group consisting of an electrical warning device, an electronic warning device, an electrical alarm device, and an electronic alarm device.

20. The method of claim 1, wherein said indicating signal generated by said device is selected from the group consisting of an audio signal, a visual signal, and, said audio signal and said visual signal, for said indicating said actual condition selected from the group consisting of excessive heat and fire.

21. The method of claim 1, wherein said at least one transducer and said electronic circuit are used for electronically testing performance of the detector.

22. The method of claim 21, wherein said at least one transducer and said electronic circuit electronically communicate with a testing electronic circuit and an associated testing mechanism for performing said electronic testing of the detector.

23. The method of claim 22, wherein said associated testing mechanism includes a controllable heat generator for supplying a test condition of said excessive heat to said internal fluid inside said enclosed volume of the detector.

24. The method of claim 1, wherein a controllable heat generator supplying a test condition of said excessive heat to said internal fluid inside said enclosed volume of the detector is used for testing performance of the detector.

25. The method of claim 1 is applicable for incorporation into a system for automatic detection selected from the group consisting of automatic heat detection, automatic fire detection, and, automatic heat and fire detection.

26. A fluid pressure electronic heat and fire detector, comprising:

(a) an enclosed volume and an internal fluid inside of said enclosed volume, said internal fluid features variable pressure responsive to variations in temperature of said internal fluid, for detecting and sensing a potential condition selected from the group consisting of excessive heat and fire;

(b) at least one transducer for sensing and determining said pressure of said internal fluid inside said enclosed volume, and for converting said sensed and determined pressure into a transducer electrical signal;

(c) an electronic circuit for receiving and analyzing said transducer electrical signal sent by said at least one transducer, and for generating an electrical signal selected from the group consisting of a warning signal and an alarm signal following logically determining that said transducer electrical signal corresponds to an actual condition selected from the group consisting of excessive heat and fire; and (d) a device for receiving said electrical signal from said electronic circuit, and for generating an indicating signal, thereby indicating said actual condition selected from the group consisting of excessive heat and fire.

27. The detector of claim 26, wherein said enclosed volume is selected from the group consisting of being closed to an external source of fluid and being open to an external source of fluid.

28. The detector of claim 26, wherein said enclosed volume includes at least one chamber for enclosing said internal fluid.

29. The detector of claim 28, wherein said at least one chamber is configured for functioning in a type of heat detector selected from the group consisting of a line-type heat detector and a spot type heat detector.

30. The detector of claim 28, wherein said at least one chamber includes an exposed part and a non-exposed part, said exposed part is for said detecting and said sensing of said potential condition by said internal fluid inside said enclosed volume.

31. The detector of claim 26, wherein said enclosed volume includes at least two chambers for enclosing said internal fluid and at least one fluid flow restrictor for restricting flow of said internal fluid between said at least two chambers.

32. The detector of claim 26, wherein said enclosed volume includes at least one fluid flow restrictor for enabling continuous communication between said enclosed volume of said internal fluid and an external source of fluid, thereby enabling automatic compensation and equilibration of said pressure of said internal fluid by pressure of said external source of fluid.

33. The detector of claim 26, wherein said internal fluid is selected from the group consisting of a gas and a liquid, said gas is selected from the group consisting of hydrogen, nitrogen, an inert gas, and ambient atmosphere.

34. The detector of claim 26, wherein level of heat considered as said excessive heat is determined by adjustment and calibration of said electronic circuit.

35. The detector of claim 26, wherein at least one of said at least one transducer is a pressure transducer.

36. The detector of claim 31, wherein said at least one transducer senses and determines a pressure difference of said internal fluid generated between said at least two chambers effected by said fluid flow restrictor positioned between said at least two chambers.

37. The detector of claim 36, wherein said at least one transducer converts said sensed and said determined said pressure difference into said transducer electrical signal.

38. The detector of claim 26, wherein said transducer electrical signal is selected from the group consisting of a voltage signal and a current signal.

39. The detector of claim 26, wherein said electronic circuit analyzes said transducer electrical signal by performing signal analysis of said transducer electrical signal for logically and definitively determining if said potential condition is an actual condition selected from the group consisting of excessive heat and fire.

40. The detector of claim 39, wherein said electronic circuit performs signal analysis by performing waveform analysis and logical operations on said transducer electrical signal.

41. The detector of claim 26, wherein said electronic circuit analyzes said transducer electrical signal according to a type of operation of said electronic circuit, said type of operation is selected from the group consisting of fixed temperature, rate of temperature rise, and, fixed temperature and rate of temperature rise.

42. The detector of claim 41, wherein said electronic circuit makes a determination selected from the group consisting of said transducer electrical signal corresponds to a pre-determined threshold level corresponding to a fixed temperature indicating a condition selected from the group consisting of excessive heat and fire, said transducer electrical signal corresponds to a pre-determined threshold level corresponding to a rate of temperature rise indicating said condition, and, said transducer electrical signal corresponds to a pre-determined threshold level corresponding to said fixed temperature and said transducer signal corresponds to a pre-determined threshold level corresponding to said rate of temperature rise.

43. The detector of claim 26, wherein said device for receiving said electrical signal from said electronic circuit is selected from the group consisting of an electrical warning device, an electronic warning device, an electrical alarm device, and an electronic alarm device.

44. The detector of claim 26, wherein said indicating signal generated by said device is selected from the group consisting of an audio signal, a visual signal, and, said audio signal and said visual signal, for said indicating said actual condition selected from the group consisting of excessive heat and fire.

45. The device of claim 26, wherein said at least one transducer and said electronic circuit are used for electronically testing performance of the detector.

46. The device of claim 45, wherein said at least one transducer and said electronic circuit electronically communicate with a testing electronic circuit and an associated testing mechanism for performing said electronic testing of the detector.

47. The device of claim 46, wherein said associated testing mechanism includes a controllable heat generator for supplying a test condition of said excessive heat to said internal fluid inside said enclosed volume of the detector.

48. The device of claim 26, wherein a controllable heat generator supplying a test condition of said excessive heat to said internal fluid inside said enclosed volume of the detector is used for testing performance of the detector.

49. The detector of claim 26 is applicable for incorporation into a system for automatic detection selected from the group consisting of automatic heat detection, automatic fire detection, and, automatic heat and fire detection.

50. A method for electronically testing the performance of the fluid pressure electronic heat and fire detector of claim 26, comprising:

(a) subjecting said internal fluid inside said enclosed volume to a test condition selected from the group consisting of excessive heat and fire;

(b) detecting and sensing said test condition by said internal fluid inside said enclosed volume;

(c) increasing pressure of said internal fluid inside said enclosed volume in response to increasing temperature of said internal fluid due to said test condition;

(d) sensing and determining said pressure of said internal fluid inside said enclosed volume by said at least one transducer;

(e) converting said sensed and determined pressure into a transducer electrical signal;

(f) sending said transducer electrical signal from said at least one transducer to said electronic circuit;

(h) receiving and analyzing said transducer electrical signal by said electronic circuit;

(i) sending an electrical signal selected from the group consisting of a warning signal and an alarm signal to said device by said electronic circuit following logical determination by said electronic circuit that said transducer electrical signal corresponds to an actual condition selected from the group consisting of excessive heat and fire; and (j) generating an indicating signal by said device, thereby indicating said actual condition selected from the group consisting of excessive heat and fire.

51. The method of claim 50, wherein the step of subjecting said internal fluid inside said enclosed volume to said test condition is effected by a testing mechanism selected from the group consisting of a manual testing mechanism and an automatic testing mechanism, said automatic testing mechanism is selected from the group consisting of an electrical automatic testing mechanism and an electronic automatic testing mechanism.

52. The method of claim 51, wherein said testing mechanism includes a controllable heat generator.

53. The method of claim 50 is applicable for incorporation into a system for automatic detection selected from the group consisting of automatic heat detection, automatic fire detection, and, automatic heat and fire detection.

54. A method for testing the performance of a fluid pressure detector selected from the group consisting of a heat detector, a fire detector, and, a heat and fire detector, comprising:

(a) heating internal fluid inside enclosed volume of the detector to a test condition of excessive heat, whereby said heating is effected by a controllable heat generator;

(b) detecting and sensing said test condition by said internal fluid inside said enclosed volume;

(c) increasing pressure of said internal fluid inside said enclosed volume in response to increasing temperature of said internal fluid due to said test condition;

(d) sensing said pressure of said internal fluid inside said enclosed volume by a fluid pressure sensing mechanism;

(e) activating a circuit in response to said sensed pressure;

(f) sending a signal selected from the group consisting of a warning signal and an alarm signal to a device by said circuit; and (g) generating an indicating signal by said device, thereby indicating said test condition of excessive heat.

55. The method of claim 54, wherein said controllable heat generator is controlled by a testing mechanism selected from the group consisting of a manual testing mechanism and an automatic testing mechanism, said automatic testing mechanism is selected from the group consisting of an electrical automatic testing mechanism and an electronic automatic testing mechanism.

56. The method of claim 54, wherein said fluid pressure sensing mechanism is selected from the group consisting of a non-electronic fluid pressure sensing mechanism and an electronic fluid pressure sensing mechanism.

57. The method of claim 56, wherein said electronic fluid pressure sensing mechanism includes at least one transducer for converting said sensed pressure into an electrical signal.

58. The method of claim 54, whereby the step of activating said circuit is performed in a mode selected from the group consisting of non-electronic activation and electronic activation, and whereby said circuit is selected from the group consisting of a non-electronic circuit and an electronic circuit.

59. The method of claim 54 is applicable for incorporation into a system for automatic detection selected from the group consisting of automatic heat detection, automatic fire detection, and, automatic heat and fire detection.

* * * * *